United States Patent [19]

Tallman

[11] Patent Number: 4,881,662

[45] Date of Patent: Nov. 21, 1989

[54] DISPENSING SPOUT

[76] Inventor: Gary C. Tallman, P.O. Box 4, Whitefish, Mont. 59937

[21] Appl. No.: 199,830

[22] Filed: May 27, 1988

[51] Int. Cl.[4] ..... B67B 7/24

[52] U.S. Cl. ..... 222/81; 222/89; 222/91; 222/543; 222/569; 285/158; 285/220; 285/362

[58] Field of Search ..... 222/81, 89, 90, 91, 222/545, 568, 569, 543; 220/85 SP; 285/158, 220, 361, 362; 30/358, 360, 366

[56] References Cited

U.S. PATENT DOCUMENTS

| | | | |
|---|---|---|---|
| 1,401,584 | 12/1921 | Cizek | 222/569 |
| 1,618,720 | 2/1927 | Moore | 222/91 |
| 3,114,480 | 12/1963 | Sauter | 222/91 X |
| 3,184,107 | 5/1965 | Kohanzo | 222/90 X |
| 3,333,737 | 8/1967 | Molineux | 222/91 |
| 3,549,049 | 12/1970 | Weber | 222/91 |
| 3,973,698 | 8/1976 | Kato | 222/91 |
| 4,712,714 | 12/1987 | Mucciarone | 222/91 |

FOREIGN PATENT DOCUMENTS

| | | | |
|---|---|---|---|
| 675333 | 12/1963 | Canada | 222/91 |
| 1418829 | 12/1975 | United Kingdom | 222/91 |

*Primary Examiner*—Joseph J. Rolla
*Assistant Examiner*—Gregory L. Huson
*Attorney, Agent, or Firm*—Diller, Ramik & Wight

[57] ABSTRACT

A dispensing spout includes a tubular body having axially opposite ends of which one end has a cutting edge for penetrating the wall of a container from which a product is to be dispensed and an opposite end of the tubular body has a groove defined by an axial groove portion and two generally radial grooved portions each ending in a blind wall. A ring is freely slidably received on the tubular body and has a tab in registration with the groove. A gasket is sandwiched between the retaining ring and the thread of the tubular body. The tab of the ring is engaged in one of the radially grooved portions for threading the tubular body into the container after the wall has been punctured. The tab is further received in the other of the radial grooves for compressing the gasket and effecting the seal between the dispensing spout and the container.

29 Claims, 2 Drawing Sheets

FIG. 1
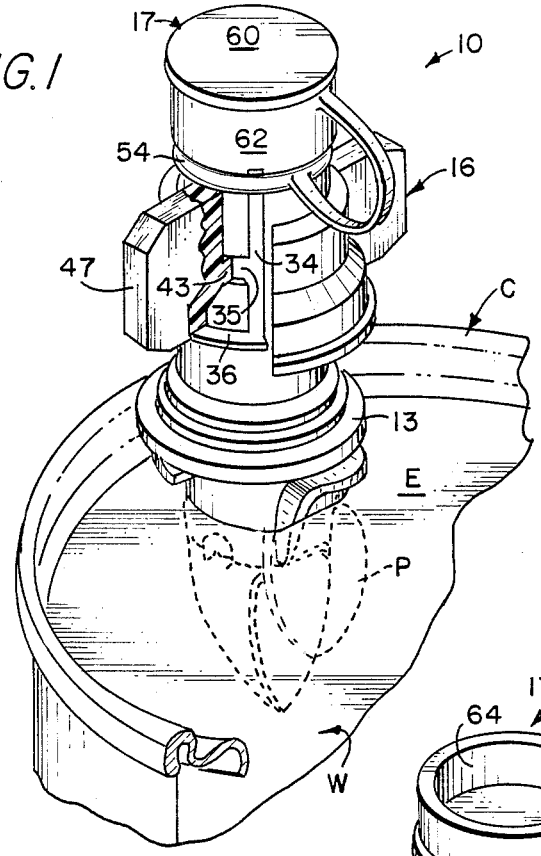
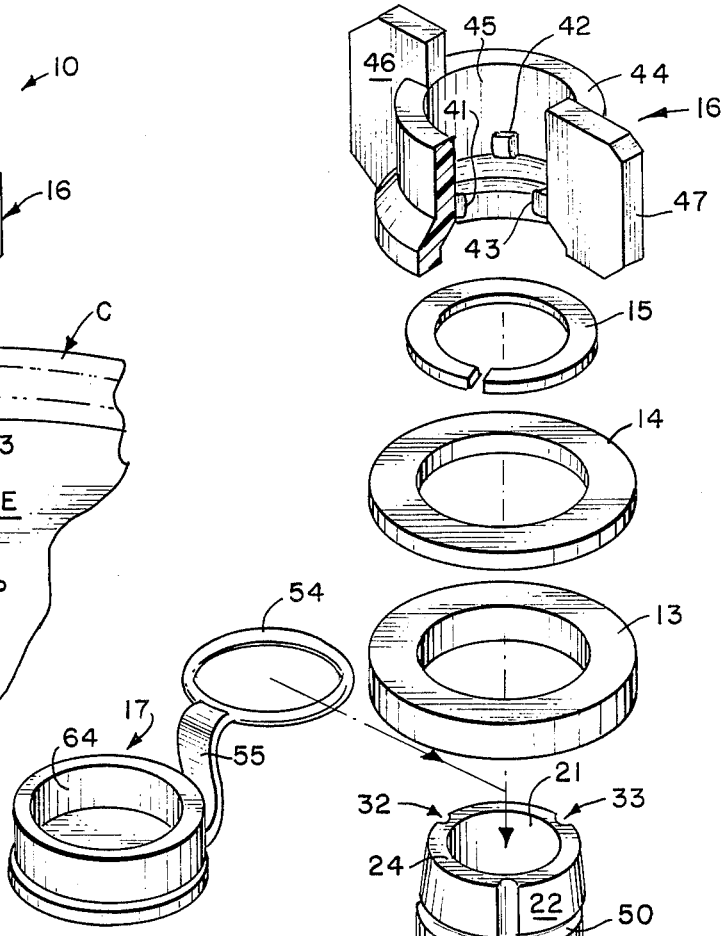
FIG. 2
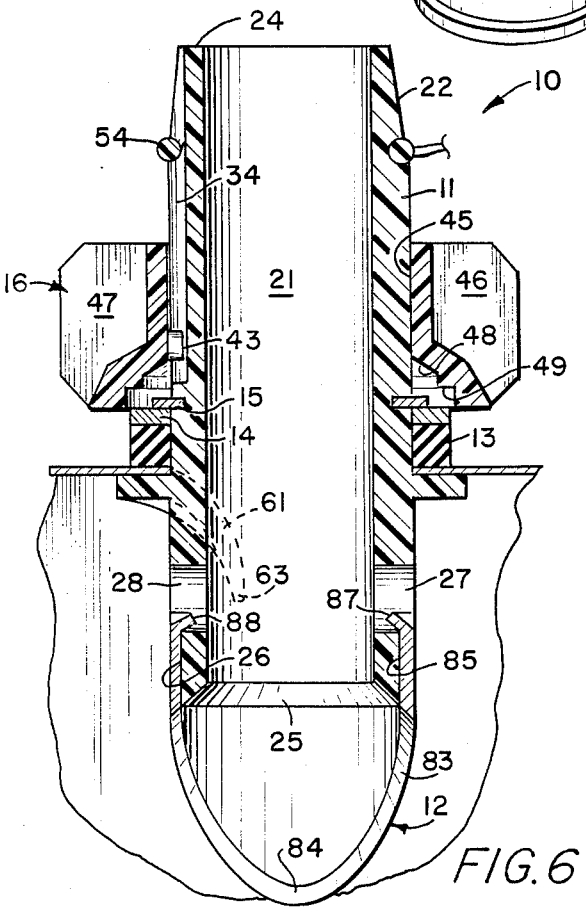
FIG. 6

FIG. 3
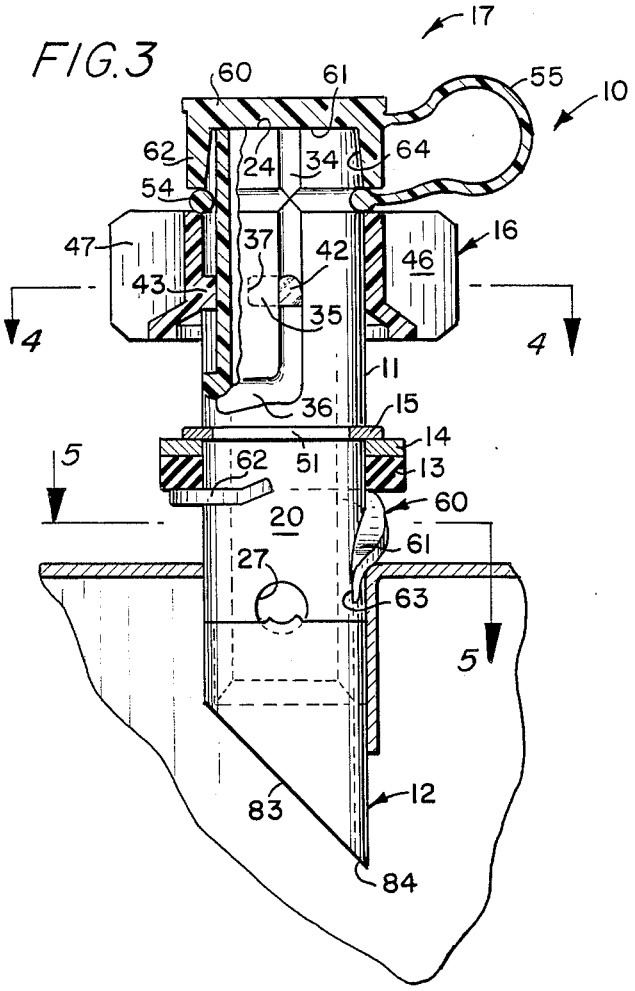
FIG. 7
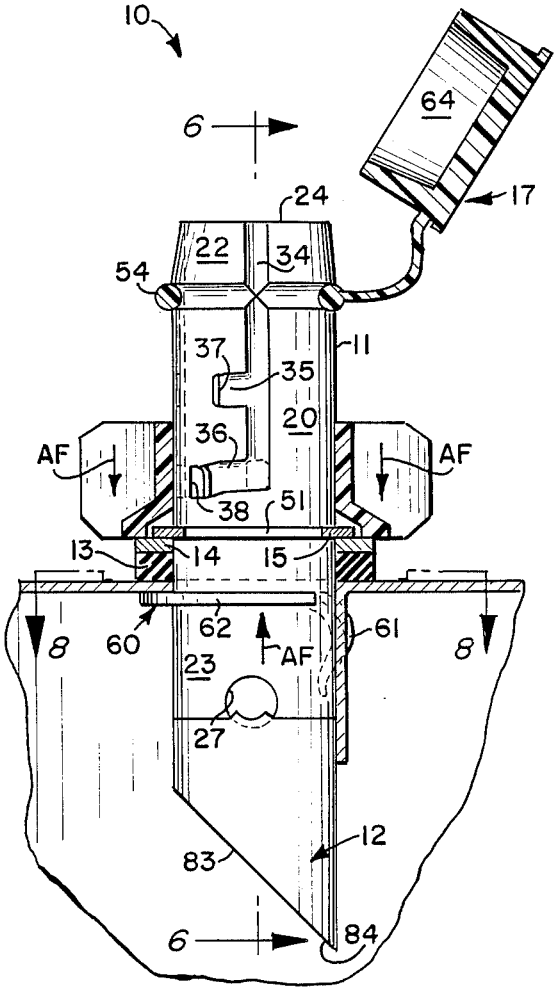
FIG. 5
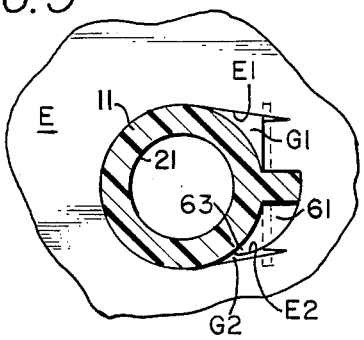
FIG. 4
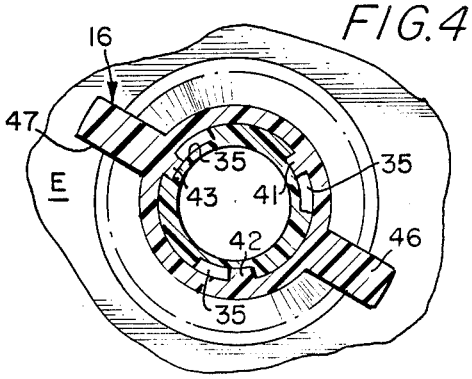
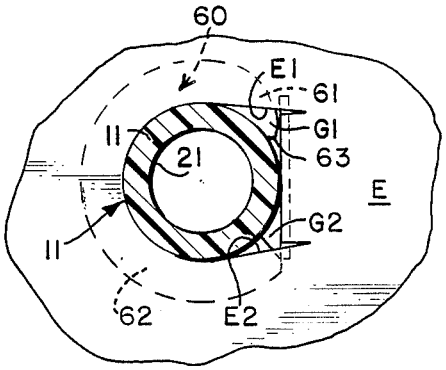
FIG. 8

DISPENSING SPOUT

BACKGROUND OF THE INVENTION

The invention relates to dispensing spouts or pouring devices normally associated with containers within which is packaged liquid, pulverulent, powdery or like material. Conventional dispensing spouts or pouring devices of this type generally include a tubular body having a pointed end which can be forced into the end of a metallic, laminated or paper stock container from which a product is to be dispensed. Normally the tubular body has a thread so that the dispensing spout can be bodily rotated and connected to the wall of the container to prevent inadvertent or accidental disassembly when in use. It is also common to associate reclosure caps with such conventional dispensing spouts.

Typical related prior art directed to conventional pouring and/or dispensing devices include the following patents: U.S. Pat. No. 3,114,480, Walter H. Sauter; U.S. Pat. No. 3,973,698, Noriyoshi Kato; U.S. Pat. No. 3,995,773, Justin M. Schmit; U.S. Pat. No. 4,475,670, Christopher C. Rutter; U.S. Pat. No. 4,562,940, Frank S. Asphar.

SUMMARY OF THE INVENTION

The novel dispensing spout of the present invention includes such conventional elements as a tubular body having axial opposite ends, a point at one of the axially opposite ends of the tubular body to penetrate the wall of a container, a cap at an opposite end of the tubular body for reclosure purposes, and a thread for threading the tubular body to the container wall. However, the dispensing spout of the present invention further includes a ring having a tab which is in axial sliding and rotating relationship to the tubular body with the tab received in at least one groove formed in an exterior surface of the tubular body. The groove includes an axial groove portion and a pair of generally radial groove portions. A thread having a starting end and a trailing end is also carried by the tubular body, and a sliding ring and gasket is sandwiched between the trailing end of the thread and a retaining clip.

The dispensing spout is placed with an associated pointed end of a cutting tip against the wall of a container which is to be opened, and an axial force is then applied to the dispensing spout progressively tearing a panel from the container wall and forming an opening therein. The starting end of the thread is aligned with a cutting shoulder of the penetrating tip so as to readily enter into the container interior.

The tab is then positioned in a first of the groove portions and the ring is rotated which first bottoms the tab against a blind wall of the first groove portion and eventually continued rotation threads the tubular body into the container until the trailing portion of the tread is internally of the container wall. Thereafter, the tab is shifted to the second groove portion which is slightly oblique to a radial plane of the tubular body axis, and upon rotation of the ring, the tab progressively causes relative axial movement between the ring and the tubular body resulting in an intimate clamping engagement of the container wall therebetween and the compression of the sealing gasket to preclude accidental or inadvertent product leakage.

A peripheral groove is also provided in the tubular body for receiving an O-ring to which is tethered a cap for reclosure purposes. The ring also prevents dispensed liquid/pulverulent material from entering the first-mentioned groove and also functions as a stop to prevent the cap from being excessively forcefit upon a tapered end portion of the tubular spout body.

With the above and other objects in view that will hereinafter appear, the nature of the invention will be more clearly understood by reference to the following detailed description, the appended claims and the several views illustrated in the accompany drawings.

BRIEF DESCRIPTION OF THE DRAWINGS

FIG. 1 is a fragmentary perspective view of a container and an associated dispensing spout of this invention, and illustrates a penetrating end of a tubular member just after a panel of the container wall has been severed thereby incident to the introduction of a leading end of a thread, a gasket and sliding ring carried by the tubular body of the spout, and a ring surrounding the tubular member and having one of three tabs registered in one of three grooves of the tubular body.

FIG. 2 is a perspective view of the dispensing spout of FIG. 1, and illustrates details of the tubular member, the grooves thereon, the thread thereof, a gasket and retaining ring, the locking ring and a tethered reclosure cap.

FIG. 3 is a fragmentary side elevational view with parts broken away and shown in cross-section for clarity, and illustrates the position of the starting end of the thread incident to rotation of the tubular member by the locking ring to thread the dispensing spout relative to the container wall.

FIG. 4 is a fragmentary sectional view taken generally along line 4—4 of FIG. 3, and illustrates the manner in which three tabs of the locking ring are associated with three grooves of the tubular body of the dispensing spout.

FIG. 5 is a fragmentary sectional view taken generally along line 5—5 of FIG. 3, and illustrates the manner in which the starting end of the thread is received in one of a pair of recesses formed by an oblique cutting edge of the penetrating end or penetrating members of the dispensing spout.

FIG. 6 is a fragmentary cross-sectional view, slightly enlarged, taken generally along 6—6 of FIG. 7, and illustrates the dispensing spout fully threaded, but not yet locked, relative to the container wall.

FIG. 7 is a fragmentary side elevational view with parts broken away and shown in cross-section for clarity, and illustrates the manner in which each tab has moved along the second groove portion of each groove to effectively compress the gasket between the retaining ring and the thread upon opposite axial motion between the tubular member and the locking ring.

FIG. 8 is a fragmentary cross-sectional view taken generally along line 8—8 of FIG. 7, and illustrates the manner in which the thread underlies the container wall in the fully connected or clamped position of the dispensing spout at which the gasket is fully compressed to prevent leakage.

DESCRIPTION OF THE PREFERRED EMBODIMENT

A novel dispensing spout or pour spout constructed in accordance with this invention is best illustrated in FIGS. 1 through 3, 6 and 7 of the drawings and is generally designated by the reference numeral 10.

The dispensing spout 10 includes a tubular body 11 (FIG. 2), penetrating means in the form of a tubular penetrating member 12, a gasket 13, a washer 14, a retaining ring 15, a rotating and locking ring 16, and a reclosure cap 17.

The tubular body 11 is constructed from injected polymeric or copolymeric plastic material, such as fiberglass reinforced polyethylene, and includes an exterior surface 20 and an interior bore or passage 21 which extends through the entire tubular body 11 between axially opposite ends or end portions 22, 23 thereof. The end portion 22 is slightly tapered (See FIGS. 3, 6 and 7), and ends at a free terminal end face 24 which lies in a radial plane while a lower terminal end face 25 (FIG. 6) is disposed at an angle of approximately 45 degrees to the axis of the tubular member 11.

Three identical groove means 31 through 33 are formed in the exterior surface 20 of the tubular member 11 for cooperating with three radially inwardly directed tabs 41 through 43 (FIG. 2) of the rotating and locking ring 16, as will be described more fully hereinafter. Each of the groove means or grooves 31 through 33 includes an axial groove portion 34, a relatively short radial groove portion 35 and a somewhat longer generally radial grooved portion 36. The groove portions 35, 36 have blind ends 37, 38, respectively. While the groove portion 35 is, in fact, generally perfectly radial (FIG. 7), the groove portion 36 is generally oblique or at a slight angle to a radial plane of the tubular member 11, as is most apparent in FIG. 7.

The tubular member 11 also includes two outwardly opening circumferential or peripheral grooves 50, 51. The groove 51 releasably receives the plastic or metallic split ring 15 which functions in conjunction with thread means 60 to hold the washer 14 and the gasket 13 sandwiched between the retaining ring 15 and the thread means 60, as is most apparent in FIGS. 3, 6 and 7 of the drawings. The washer 14 is preferably of relatively rigid plastic or metallic material, whereas the gasket 13 is, of course, formed of resilient rubber or like sealing material.

The groove 50 has a bottom which merges with the bottom of each of the axial groove portions 34 of the grooves 31 through 33. The groove 50 receives a resilient O-ring 54 which is connected by a tether or strap 55 to the cap 17 thereby securing the cap 17 to the end portion 22 in both the closed (FIG. 3) and open (FIG. 7) positions thereof. Furthermore, since the groove portions 34 and the groove 50 mate at the intersections thereof, any material which might otherwise tend to drip down from the end face 24 along the end portion 22 or any of the axial groove portions 34 will be prevented from passing beyond the Oring 54, and thus therebeneath the grooves 31 through 33 will at all times be kept free of material which might clog or otherwise reduce the cooperative operability of the grooves 31 through 33 and the respective tabs 41 through 43.

The cap or closure 17 also includes an end panel 60 having an inner surface 61 and a peripheral skirt 62 having an end face 63. An inner peripheral surface 64 of the peripheral skirt 62 conforms generally to the taper of the end portion 22 of the tubular member 11. Furthermore, the axial distance between the surface 61 of the end panel 60 and the end face 63 corresponds generally to the axial distance between the end face 24 of the tubular member 11 and the O-ring 54 seated in the groove 50. Thus, the end face 63 will abut against the O-ring 54 and the latter will prevent the cap 17 from being pushed downwardly, as viewed in FIG. 3, beyond the intended position to thereby prevent overtightening or binding between the surface 64 of the peripheral skirt 62 and the end portion 22 of the tubular member 11.

At the end portion 23 of the tubular member 11 the thread means 60 includes a progressively downwardly curving end converging starting thread portion 61 which within approximately 45 degrees of arc merges with a terminal thread portion 62 which lies in a generally radial plane and has an arcuate extend of approximately 200–215 degrees. A terminal end 63 of the starting thread portion 61 is on an axial plane P (FIG. 2) just inboard of a cutting shoulder 81 of a pair of diametrically opposite cutting shoulders 81, 82 of a oblique cutting edge 83 having a point 84, all forming portions of the penetrating or cutting member 12 which is preferably generally of a tubular configuration and is constructed from relatively hard steel. An inner circumferential surface 85 (FIG. 6) of the penetrating member 12 intimately engages a reduced circumferential surface 26 of the tubular member 11, and the latter also includes two diametrically opposite radial bores or ports 27, 28 into which tabs 87, 88, respectively, are crimped (FIG. 6) to retain the penetrating member 12 in rigid assembled relationship to the tubular member 11.

The rotating and locking ring 16 includes a peripheral wall 44 having an internal bore 45 (FIG. 2) beyond which project the tabs 41 through 43. A pair of diametrically oppositely directed exterior radial wings 46, 47 facilitate gripping and rotation of the ring 16, as will be described more fully hereinafter. The bore 45 is obliquely counterbored at 48 (FIG. 6) and further counterbored at 49 to freely accommodate therein the retaining ring 15 and washer 14, respectively.

The dispensing spout 10 is used by first positioning the point 84 of the penetrating member 12 against an end panel E of a wall W of a container C which is constructed of metallic, paper stock or laminated material and may contain liquid, pulverulent, powdery or like flowable material which is to be dispensed from the container C. An axial downward force is then applied to the dispensing spout 10 causing the point 84 to initially penetrate the end panel E followed by subsequent progressive severance of a panel portion P in a progressive manner by the cutting edge 83. A maximum diameter of the cut panel P is achieved as the cutting shoulders 81, 82 pass through the end panel E which occurs after approximately 180 degrees of the end panel has been cut. Thereafter, as the dispensing spout 10 is inserted further through the end panel E, the panel P is no longer subjected to the cutting edge 83, and instead the end panel E is simply torn along generally tangential edges E1, E2 resulting in the formation of respective gaps G1, G2 of which the latter, which lies adjacent the cutting shoulder 81 permits ready access of the end 63 of the thread 60 therethrough and beneath end panel E generally to the position shown in FIG. 3.

The rotating and locking ring 16 is then positioned with the tabs 41 through 43 thereof aligned with the groove portions 35. The latter is done by "feel", but this alignment can also be augmented or assured by axially dimensioning the position of the O-ring 54 relative to the groove portions 35 such that when the rotating and locking ring 16 is raised upwardly into contact with the O-ring 54, the tabs 41 through 43 are in alignment with the groove portions 35 (FIG. 3). Thereafter, the locking ring 16 is turned clockwise during which time each tab 41 through 43 enters into its associated groove portion 35. At this point, the tubular member 11 is motionless but upon subsequent continued clockwise rotation, the tabs 41 through 43 strike the blind ends or walls 37 of each of the groove portions 35 and continued rotation of the rotating and locking means 16 imparts rotation to the tubular member 11 and threads the same into the container C as the leading edge portion 61 of the thread 62 progressively engages beneath the end panel E and draws the entire thread 60 including the trailing end portion 62 thereof beneath the end panel E to the position shown in FIGS. 6 and 8. In the position shown in FIG. 6, the dispensing spout 10 is loosely threaded into the end panel E of the wall W but is not locked or sealed thereagainst.

The rotating and locking ring 16 is then rotated counterclockwise to remove the tabs 41 through 43 from the associated groove portions 35, then lowered axially downwardly and rotated clockwise bringing the tabs 41 through 43 into the associated groove portions 36. Since the groove portions 36 are tapered downwardly, as viewed from right-to-left in FIGS. 3 and 7 or in a clockwise direction, the tabs 41 through 43, as they move into the groove portions 36, creates axial forces AF (FIG. 7) moving the ring 16 axially relative to the tubular member 11. Since the trailing end portion 62 of the thread 60 lies beneath the end panel E (FIG. 7) during the latter described rotation, it effectively retains the tubular member 11 generally stationary and for the most part the locking ring 16 descends downwardly from the position shown in FIG. 6 to the position shown in FIG. 7 at which time the counterbored surface 49 (FIG. 6) engages the washer 14 which in turn compresses the gasket 13 (FIG. 7). The cap 17 can then be removed and the contents of the container C dispense through the bores 27, 28 and/or 21, or alternatively a paint brush or similar instrument can be placed into the interior of the container C through the passage 21 to gain access to the contents packaged therein. Once a particular dispensing operation is completed, the cap 17 can be reclosed upon the end portion 22, and the operation repeated as necessary. Obviously, the entire dispensing spout 10 can be removed and reused, as is found necessary or desirable.

Although a preferred embodiment of the invention has been specifically illustrated and described herein, it is to be understood that minor variations may be made in the apparatus without departing from the spirit and scope of the invention. For example, instead of the three grooves 31 through 33 and the corresponding three radially inwardly directed tabs 41 through 43, the dispensing spout 10 can instead have only two grooves and two radially inwardly directed tabs, and these preferably would be located on opposite sides of a diametric plane through the tubular body 11 and the locking ring 16, respectively. The operability of the pour spout 10 would remain uneffected, yet the cost of manufacture thereof would be lessened because the mold in which the spout body 11 and sleeve 16 are injection-molded would be less expensive to manufacture.

Another modification would be that of forming the entire spout body 11 from plastic material including the separately manufactured and attached tubular penetrating member 12. If, for example, the spout body 11 and penetrating member 12 were made of a single homogeneous piece of glass reinforced polyethylene, most cans having soft ends could be readily opened, and even metallic ends could be opened by first using a nail to form a starting opening in the metallic can end. The metal at the starting opening would be quite easily torn by the edge 83 as the spout body 11 is forced toward the interior of the can body. The point 84 thus virtually performs no impact or penetrating function and the edge 83 basically wedges or tears the metal of the can end.

When the spout body 11 is made of plastic material, the holes 27, 28 can be retained or eliminated, and preferably the same eliminated and in lieu thereof a single elongated slot 89 (FIG. 2) is provided at what would be the lower end of the one piece nylon reinforced plastic pour spout 11 being formed in the portion therof diametrically opposite to the point 84.

I claim:

1. A dispensing spout comprising a generally tubular body defining a passage therethrough between axially opposite end portions of said tubular body, means at one axial end portion of said tubular body for penetrating a wall of a container within which is packaged a dispensable product, said tubular body including thread means for connecting said tubular body to said wall upon rotation of said tubular body, a ring surrounding said tubular body in free axial reciprocal sliding relationship thereto, and said ring including first means in external free axially reciprocal sliding relationship and rotating relationship to said tubular body and cooperative with second means upon said tubular body for initially imparting rotation to said tubular body thereby threading said thread means to an associated container wall followed by a relative axial movement between said tubular body and said first means and thereafter a relative rotational movement between said tubular body and said first means to clampingly connect said tubular body to an associated container wall.

2. The dispensing spout as defined in claim 1 wherein said cooperative first and second means are defined by a tab slidably received in a groove.

3. The dispensing spout as defined in claim 1 wherein said cooperative first and second means are defined by a groove in an exterior peripheral surface of said tubular body and a tab slidably received therein.

4. The dispensing spout as defined in claim 1 wherein said cooperative first and second means are defined by a tab defined by said ring slidably received in a groove of said tubular body.

5. The dispensing spout as defined in claim 1 including gasket means carried by said tubular body for forming a seal with an associated penetrated wall, retaining means in axially spaced relationship to a portion of said thread means for retaining said gasket means between said thread means portion and said retaining means, and said cooperative first and second means further effect compression of said gasket means during relative axial movement between said tubular body and said first means.

6. The dispensing spout as defined in claim 1 wherein said tubular body includes a cap at another of said axially opposite tubular body end portions for selectively opening and closing said passage, said cap having an end panel and a peripheral skirt ending in a terminal edge, said terminal edge being spaced a first predetermined distance from an interior surface of said cap end panel, said another end portion having a terminal end, a groove in said another end portion having an edge most adjacent said another end portion terminal end spaced a second predetermined distance from said another end portion terminal end, a ring in said groove, a flexible connector between said ring and said cap, and said predetermined distance being approximately equal whereby said cap terminal edge contacts said ring to prevent the cap from being excessively forced upon said another end portion in the closed position of said cap.

7. The dispensing spout as defined in claim 1 wherein said penetrating means includes an oblique cutting edge including a point and diametrically opposite edge portions, and said thread means includes a thread having a starting thread end portion in general axial alignment with one of said diametrically opposite edge portions to facilitate the introduction of said thread means into an associated wall during the penetration thereof.

8. The dispensing spout as defined in claim 1 wherein said penetrating means is a tubular member having an oblique cutting edge, and means for crimping said tubular member to said tubular body.

9. The dispensing spout as defined in claim 1 wherein said tubular body includes at least one radial bore, said penetrating means is a tubular member having an oblique cutting edge, and means for crimping said tubular member to said tubular body radial bore.

10. The dispensing spout as defined in claim 1 wherein said second means includes at least one generally inverted L-shaped groove defined by a generally axially extending groove portion and a generally peripherally extending groove portion.

11. The dispensing spout as defined in claim 10 wherein said first means includes a tab carried by said ring slidably received in said one groove.

12. The dispensing spout as defined in claim 1 wherein said second means includes at least one generally inverted F-shaped groove defined by a generally axially extending groove portion and a pair of generally peripherally extending groove portions.

13. The dispensing spout as defined in claim 12 wherein said first means includes a tab carried by said ring slidably received in said one groove.

14. The dispensing spout as defined in claim 1 wherein said cooperative first and second means are defined by a tab slidably received in a groove, said tab being defined by one of said tubular body and ring, and said groove being defined by the other of said tubular body and ring.

15. The dispensing spout as defined in claim 14 including gasket means carried by said tubular body for forming a seal with an associated penetrated wall, retaining means in axially spaced relationship to a portion of said thread means for retaining said gasket means between said thread means portion and said retraining means, and said cooperative first and second means further effect compression of said gasket means during relative axial movement between said tubular body and said first means.

16. The dispensing spout as defined in claim 14 wherein said tubular body includes a cap at another of said axially opposite tubular body end portions for selectively opening and closing said passage, said cap having an end panel and a peripheral skirt ending in a terminal edge, said terminal edge being spaced a first predetermined distance from an interior surface of said cap end panel, said another end portion having a terminal end, a groove in said another end portion having an edge most adjacent said another end portion terminal end spaced a second predetermined distance from said another end portion terminal end, a ring in said groove, a flexible connector between said ring and said cap, and said predetermined distance being approximately equal whereby said cap terminal edge contacts said ring to prevent the cap from being excessively forced upon said another end portion in the closed position of said cap.

17. The dispensing spout as defined in claim 14 wherein said penetrating means includes an oblique cutting edge including a point and diametrically opposite edge portions, and said thread means includes a thread having a starting thread end portion in general axial alignment with one of said diametrically opposite edge portions to facilitate the introduction of said thread means into an associated wall during the penetration thereof.

18. The dispensing spout as defined in claim 1 including a gasket surrounding said tubular body, said gasket being housed between axial abutment means of said tubular body and a trailing end portion of said thread means, said first means being a ring carrying a tab, said second means being a groove in an exterior peripheral surface of said tubular body slidably receiving said tab therein, and said tab and groove are constructed and arranged to compress said gasket upon relative axial movement between said ring and tubular body as the tubular body is clampingly connected to an associated container wall.

19. The dispensing spout as defined in claim 18 wherein said groove includes an axial groove portion and two axial spaced peripheral groove portions, a first of said peripheral groove portions being disposed in a generally radial plane of said tubular body, and a second of said peripheral groove portions being disposed generally obliquely to said radial plane.

20. The dispensing spout as defined in claim 19 wherein said penetrating means includes an oblique cutting edge including a point and diametrically opposite edge portions, and said thread means includes a thread having a starting thread end portion in general axial alignment with one of said diametrically opposite edge portions to facilitate the introduction of said thread means into an associated wall during the penetration thereof.

21. The dispensing spout as defined in claim 19 wherein said tubular body includes a cap at another of said axially opposite tubular body end portions for selectively opening and closing said passage, said cap having an end panel and a peripheral skirt ending in a terminal edge, said terminal edge being spaced a first predetermined distance from an interior surface of said cap end panel, said another end portion having a terminal end, a groove in said another end portion having an edge most adjacent said another end portion terminal end spaced a second predetermined distance from said another end portion terminal end, a ring in said groove, a flexible connector between said ring and said cap, and said predetermined distanced being approximately equal whereby said cap terminal edge contacts said ring to prevent the cap from being excessively forced upon said another end portion in the closed position of said cap.

22. The dispensing spout as defined in claim 21 wherein said penetrating means includes an oblique cutting edge including a point and diametrically opposite edge portions, and said thread means includes a thread having a starting thread end portion in general axial alignment with one of said diametrically opposite edge portions to facilitate the introduction of said thread means into an associated wall during the penetration thereof.

23. A dispensing spout comprising a generally tubular body defining a passage therethrough between axially opposite end portions of said tubular body, means at one axial end portion of said tubular body for penetrating a wall of a container within which is packaged a dispensable product, said tubular body including thread means for connecting said tubular body to said wall upon rotation of said tubular body, first means in external axially sliding and rotating relationship to said tubular body and cooperative with second means upon said tubular body for initially imparting rotation to said tubular body thereby threading said thread means to an associated container wall followed by relative axial movement between said tubular body and said first means to clampingly connect said tubular body to an associated container wall, a ring surrounding said tubular body, said cooperative first and second means are defined by a tab defined by said ring slidably received in a groove of said tubular body, and said groove including an axial groove portion and two axially spaced peripheral groove portions.

24. A dispensing spout comprising a generally tubular body defining a passage therethrough between axially opposite end portions of said tubular body, means at one axial end portion of said tubular body for penetrating a wall of a container within which is packaged a dispensable product, said tubular body includign thread means for connecting said tubular body to said wall upon rotation of said tubular body, first means in external axially sliding and rotating relationship to said tubular body and cooperative with second means upon said tubular body for initially imparting rotation to said tubular body thereby threading said thread means to an associated container wall followed by relative axial movement between said tubular body and said first means to clampingly connect said tubular body to an associated container wall, a ring surrounding said tubular body, said cooperative first and second means are defined by a tab defined bys aid ring slidably received in a groove of said tubular body, said groove includes an axial groove portion and two axially spaced peripheral groove portions, a first of said peripheral groove portions being disposed in a generally radial plane of said tubular body, a second of said peripheral groove portions being disposed generally obliquely to said radial plane, and both of said peripheral groove portions have blind ends.

25. A dispensing spout comprising a generally tubular body defining a passage therethrough between axially opposite end portions of said tubular body, means at one axial end portion of said tubular body for penetrating a wall of a container within which is packaged a dispensable product, said tubular body including thread means for connecting said tubular body to said wall upon rotation of said tubular body, first means in external axially sliding and rotating relationship to said tubular body and cooperative with second means upon said tubular body for initially imparting rotation to said tubular body thereby threading said thread means to an associated container wall followed by relative axial movement between said tubular body and said first means to clampingly connect said tubular body to an associated container wall, a ring surrounding said tubular body, said cooperative first and second means are defined by a tab defined by said ring slidably received in a groove of said tubular body, said groove includes an axial groove portion and two axially spaced peripheral groove portions, a first of said peripheral groove portions being disposed in a generally radial plane of said tubular body, and a second of said peripheral groove portions being disposed generally obliquely to said radial plane.

26. The dispensing spout as defined in claim 25 wherein said tubular body includes a cap at another of said axially opposite tubular body end portions for selectively opening and closing said passage, said cap having an end panel and a peripheral skirt ending in a terminal edge, said terminal edge being spaced a first predetermined distance from an interior surface of said cap end panel, said another end portion having a terminal end, a groove in said another end portion having an edge most adjacent said another end portion terminal end spaced a second predetermined distance from said another end portion terminal end, a ring in said groove, a flexible connector between said ring and said cap, and said predetermined distance being approximately equal whereby said cap terminal edge contacts said ring to prevent the cap from being excessively forced upon said another end portion in the closed position of said cap.

27. The dispensing spout as defined in claim 25 wherein said penetrating means includes an oblique cutting edge including a point and diametrically opposite edge portions, and said thread means includes a thread having a starting thread end portion in general axial alignment with one of said diametrically opposite edge portions to facilitate the introduction of said thread means into an associated wall during the penetration thereof.

28. The dispensing spout as defined in claim 25 including gasket means carried by said tubular body for forming a seal with an associated penetrated wall, retaining means in axially spaced relationship to a portion of said thread means for retaining said gasket means between said thread means portion and said retraining means, and said cooperative first and second means further effect compression of said gasket means during relative axial movement between said tubular body and said first means.

29. The dispensing spout as defined in claim 28 wherein said tubular body includes a cap at another of said axially opposite tubular body end portions for selectively opening and closing said passage, said cap having an end panel and a peripheral skirt ending in a termina edge, said terminal edge being spaced a first predetermined distance from an interior surface of said cap end panel, said another end portion having a terminal end, a groove in said another end portion having an edge most adjacent said another end portion terminal end spaced a second predetermined distance from said another end portion terminal end, a ring in said groove, a flexible connector between said ring and said cap, and said predetermined distance being approximately equal whereby said cap terminal edge contacts said ring to prevent the cap from being excessively forced upon said another end portion in the closed position of said cap.

* * * * *